US005509769A

United States Patent [19]

Larson et al.

[11] Patent Number: 5,509,769

[45] Date of Patent: Apr. 23, 1996

[54] BARBED LIGHT WEIGHT CONCRETE FASTENER AND PLATE

[75] Inventors: Paul M. Larson, Palatine, Ill.; Donald H. Egan, Dallas, Tex.

[73] Assignee: Illinois Tool Works Inc., Glenview, Ill.

[21] Appl. No.: 321,553

[22] Filed: Oct. 12, 1994

[51] Int. Cl.[6] ..... F16B 15/02; F16B 15/06; E04B 1/00; E04B 5/00

[52] U.S. Cl. ..... 411/456; 411/478; 411/480; 411/545; 411/923; 52/366; 52/512; 52/746.11

[58] Field of Search ..... 411/446, 456, 411/461, 464, 471, 477, 478, 479, 480, 531, 533, 545, 923, 258; 52/361, 366, 410, 512, 747

[56] References Cited

U.S. PATENT DOCUMENTS

| | | | |
|---|---|---|---|
| 3,710,672 | 1/1973 | Hallock . | |
| 4,031,802 | 6/1977 | Hallock . | |
| 4,289,058 | 9/1981 | Paskert | 411/480 X |
| 4,574,551 | 3/1986 | Giannuzzi | 52/512 |
| 4,641,472 | 2/1987 | Young et al. | 52/361 |
| 5,102,275 | 4/1992 | Hulsey | 411/545 X |
| 5,125,779 | 9/1992 | Hallock et al. | 411/446 |
| 5,163,798 | 11/1992 | McGovern | 411/448 |

FOREIGN PATENT DOCUMENTS

| | | | |
|---|---|---|---|
| 449332 | 4/1968 | Switzerland | 411/456 |
| 2002868 | 2/1979 | United Kingdom | 411/456 |

*Primary Examiner*—Neill R. Wilson

*Attorney, Agent, or Firm*—Mark Croll; Thomas Buckman; John P. O'Brien

[57] ABSTRACT

A barbed light weight concrete fastener and plate comprises a fastener with a head and two bendable legs. Each leg has a barb and a bump protruding therefrom. The fastener is pushed through a base ply and into a roof deck of cementitious material. The legs diverge to capture a concrete wedge between them. The barbs dig into the concrete wedge to increase resistance to a pullout force. The bumps create pressure points with the cementitious material that further resist pullout. A plate may be interposed between the fastener and the base ply. The plate has a number of openings therethrough of relatively large area. The openings are filled with plugs of asphalt that adhere to the base ply. Pulling of the base ply is resisted by the plate acting against the shear areas between the asphalt plugs and the base ply.

22 Claims, 2 Drawing Sheets

BARBED LIGHT WEIGHT CONCRETE FASTENER AND PLATE

BACKGROUND OF THE INVENTION

1. Field of the Invention

This invention pertains to roofing systems, and more particularly to apparatus for holding waterproof membranes to flat roof decks.

2. Description of the Prior Art

It is well known to construct buildings with flat built-up roofs that include a deck of cementitious material. The cementitious material is poured over a metal or concrete framework that provides the load bearing structure for the roof. In many cases, the cementitious material is used in combination with an insulating material. The top surface of the cementitious material is typically covered with two or more plys of flexible waterproof membranes.

The base ply adjacent the top surface of the cementitious material may be held in place by expandable fasteners such as are shown in U.S. Pat. No. 3,710,672. The fastener of that patent is comprised of a flat head and two legs pivotally joined to the head. The fastener legs are driven through the base ply and into the cementitious material before the material is fully cured. The fastener legs spread apart as they penetrate the cementitious material. When the cementitious material has fully cured, the material between the divergent legs prevent the legs from bending back to their original position. The divergent legs thus resist pullout of the fastener. Similar fasteners may be seen in U.S. Pat. Nos. 4,031,802; 4,641,472; 5,125,779; and 5,163,798.

If desired, a thin washer or plate having an area greater than the fastener head area can be used between the fastener head and the base ply. A typical plate is shown in U.S. Pat. No. 4,627,207.

After the base ply, fasteners, and plates are in place, a thin layer of asphalt is typically mopped over the entire roof. Another ply can then be laid on top of the asphalt.

The plate of U.S. Pat. No. 4,627,207 is designed to enable asphalt to flow between portions of the plate and the underlying base ply. In that manner, a portion of the base ply under the plate becomes bonded to the plate. However, it is difficult to mop asphalt into the narrow spaces between the plate of the U.S. Pat. No. 4,627,207 and the base ply.

It is a characteristic of cementitious material as used in building roofs that it tends to soften with time. Changing temperatures, as well as any excess moisture between the base ply and the cementitious material, aggravate that situation. As the cementitious material softens, the pullout resistance of the roofing fasteners decreases. Ultimately, the integrity of the roofing system fails, and repairs must be made. If the cementitious material has softened to the point that the prior fasteners are no longer able to perform properly, the cementitious material must be replaced. That, of course, is an expensive and time consuming project.

Accordingly, there is room for improvements in built-up roofing systems.

SUMMARY OF THE INVENTION

In accordance with the present invention, a barbed light weight concrete fastener and plate are provided that have improved ability to hold flexible membranes to roof decks made of cementitious material. This is accomplished by fabricating the fastener with protrusions on its legs and the plate with several through openings of large area.

The fastener of the invention is comprised of a flat head and two legs. Each leg has a first end bendably joined to the head and a free end. The legs are channel shaped, each having a middle wall and two side walls. In an inoperative mode, the legs are generally parallel, and one leg nests inside the other. The middle walls of the legs curve convexly toward each other. In an operative mode, the free ends of the legs diverge.

On the middle wall of each leg near the free end thereof is a first protrusion. In the preferred embodiment, the first protrusion is in the form of a barb that faces inwardly toward the middle wall of the other leg.

There is also a second protrusion on the middle wall of each fastener leg. Each second protrusion is in the form of a small bump. The bumps face outwardly away from the middle wall of the other leg.

Further in accordance with the present invention, the plate is designed to reliably enable bonding of asphalt to the base ply underlying the plate and to a top ply overlying the plate. For that purpose, the plate is generally flat with the exception of a single annular rib. The plate defines a number of openings therethrough arranged between the rib and the plate periphery. To assure structural rigidity to the plate despite the openings, the openings are relatively few in number and have obround shapes. The plate has a central hole that receives the legs of the fastener. Tabs on the plate retain the fastener head to the plate.

The barbed light weight concrete fastener and plate of the invention are used by pushing the fastener head such that the free ends of the fastener legs penetrate through the base ply of the roofing system and into the underlying cementitious deck. As the fastener legs penetrate the cementitious material, they spread apart. When the plate has contacted the base ply, the fastener legs have created a concrete wedge between them. The barbs on the fastener legs dig into the concrete when there is a removing force on the fastener. As the barbs dig into the concrete, they allow the legs to capture a larger concrete wedge than prior fasteners. When the fastener is attempted to be extracted from the cementitious material, the increased size of the concrete wedge provides an increased bearing area of the fastener legs against the overlying cementitious material, thereby enhancing the fastener's holddown ability. The bumps on the fastener legs create pressure points against the cementitious material that increase frictional resistance to fastener pullout. The fastener is thus particularly useful in reroofing applications, because it can often provide satisfactory holddown force to the base ply even with a cementitious deck that has lost some of its compressive strength.

With the barbed fasteners and plates of the present invention in place, the base ply, fastener heads, and plates are covered with asphalt. The large openings in the plates fill with asphalt plugs that adhere to the areas of the base ply at the bottom of the plate openings and to the top ply at the top of the openings. The areas of bonding between the base ply and the asphalt plugs form large shear areas that cooperate with the plate to resist pulling of the base ply during high winds. They also enhance the adhesion between the base and top plys at the area of the fastener and plate.

The method and apparatus of the invention, using protrusions on the fastener legs and relatively few large obround openings in the plate, thus provide increased holddown strength in cementitious material. The necessity of pouring new cementitious decks at the time of reroofing is often eliminated.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring first to FIGS. 4–7, a barbed light weight concrete fastener 1 is illustrated that includes the present invention. The fastener 1 is useful for holding a flexible waterproof membrane to a cementitious roof deck.

Figure 1:
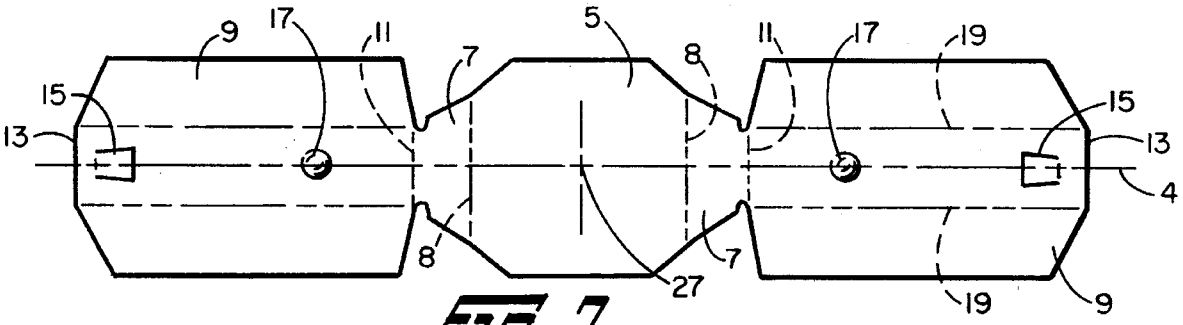
FIG. 1 is a top view of a blank of material from which the fastener of the present invention is fabricated.
Figure 2:
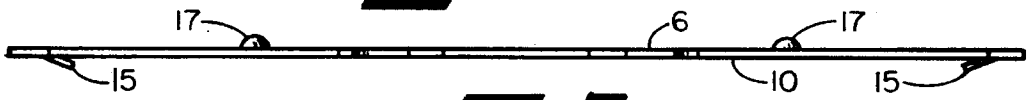
FIG. 2 is a front view of FIG. 1.

In the preferred embodiment, the fastener 1 is made from a sheet of coated steel, such as that marketed under the trademark Galvalume. A steel sheet approximately 0.013 inches to 0.015 inches thick works very well. The steel sheet is punched to form a blank 3, as is shown in FIGS. 1 and 2, having a top surface 6 and a bottom surface 10 and defining a longitudinal centerline 4. The blank 3 has a head 5 that defines a central axis 27. A pair of first tabs 7 extend oppositely along the longitudinal centerline 4 and are joined to the head 5 along respective fold lines 8. A pair of second tabs 9 are joined to the first tabs 7 along respective fold lines 11.

In accordance with the present invention, the blank 3 is punched near the free ends 13 of each second tab 9 and generally along the longitudinal centerline 4 to create three-sided barbs 15. The barbs 15 protrude from the blank bottom surface 10.

The blank 3 is further punched with a bump 17 on each second tab 9. Each bump 17 is located along the longitudinal centerline 4 about 30 percent of the distance from the fold line 11 to the tab free end 13. The bumps may be in the form of hemispheres, and they protrude from the blank top surface 6.

Figure 3:
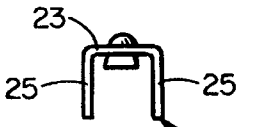
FIG. 3 is an end view of the blank during a stage in the manufacture of the fastener of the present invention.
Figure 5:
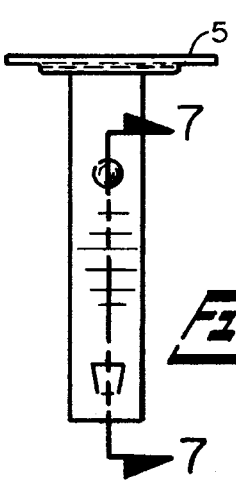
FIG. 5 is a side view of FIG. 4.
Figure 4:
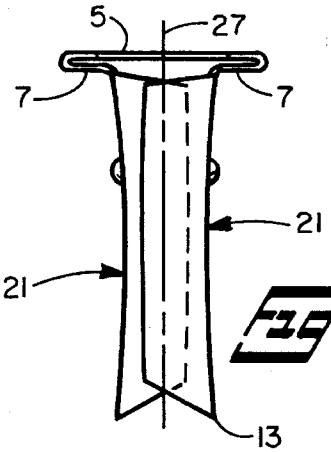
FIG. 4 is a front view of the fastener of the present invention shown in the inoperative mode.
Figure 6:
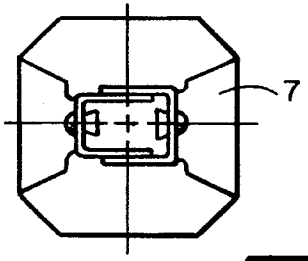
FIG. 6 is a bottom view of FIG. 4.
Figure 7:
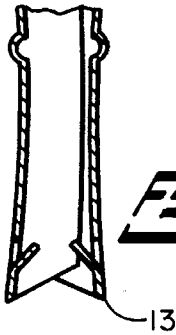
FIG. 7 is a cross sectional view taken along line 7—7 of FIG. 5.

To make the fastener 1 from the blank 3, each second tab 9 is folded at right angles along fold lines 19 toward the blank bottom surface 10, FIG. 3. The result is the formation of two legs 21, each having a middle wall 23 and two side walls 25. Simultaneously, the second tabs are bent such that the middle wall 23 of each leg 21 is concave along its top surface 6. The legs 21 are bent at right angles along fold lines 11 toward the blank top surface. Finally, the two first tabs 7 are bent back along respective fold lines 8 to underlie the head 7. The result is the fastener of FIGS. 4–7. Satisfactory dimensions for the fastener include a head approximately 1.10 inches across and legs approximately 1.174 inches long.

The fastener 1 of FIGS. 4–7 is shown in an inoperative mode, whereat the legs 21 lie generally parallel to the central axis 27. In that situation, one leg nests inside the other.

Figure 8:
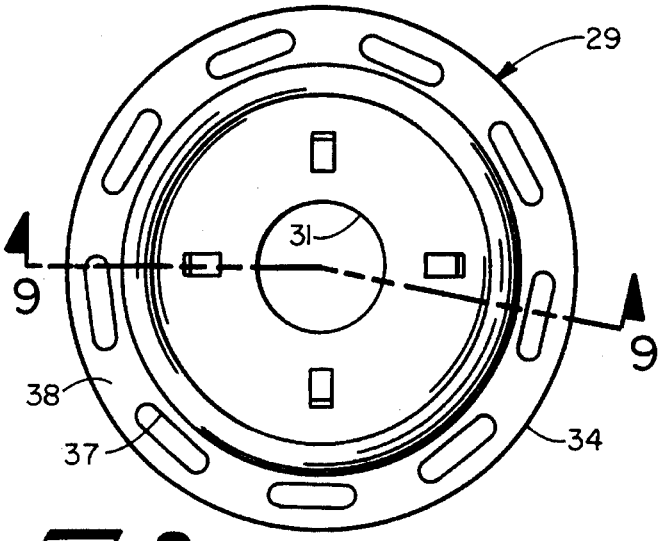
FIG. 8 is a top view of the plate of the present invention.
Figure 9:
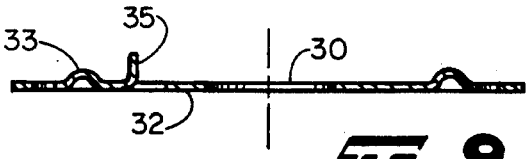
FIG. 9 is a cross sectional view taken along line 9—9 of FIG. 8.

FIGS. 8 and 9 show the plate 29 of the present invention. The plate 29 may be made from the same coated steel material as the fastener 1. The plate has a top surface 30, a bottom surface 32, an outer periphery 34, and a central hole 31. A strengthening rib 33 projects above the plate top surface 30. Tabs 35, preferably four in number, are punched in the plate and are bent 90 degrees to the top surface. Satisfactory dimensions for the plate include an outer diameter of approximately 2.70 inches, and a central hole diameter of approximately 0.68 inches. The rib 33 has an inner diameter of approximately 1.77 inches and an outer diameter of approximately 2.05 inches.

It is a feature of the present invention that a number of openings 37 having relatively large areas are formed in the plate 29 between the rib 33 and the outer periphery 34. In the illustrated construction, the openings 37 are obround in shape, because that shape provides optimum total area for the openings and structural rigidity of the plate. Openings approximately 0.50 inches long and approximately 0.13 inches wide, with a rim 38 of approximately 0.12 inches between the openings and the outer periphery, work very well.

Figure 10:
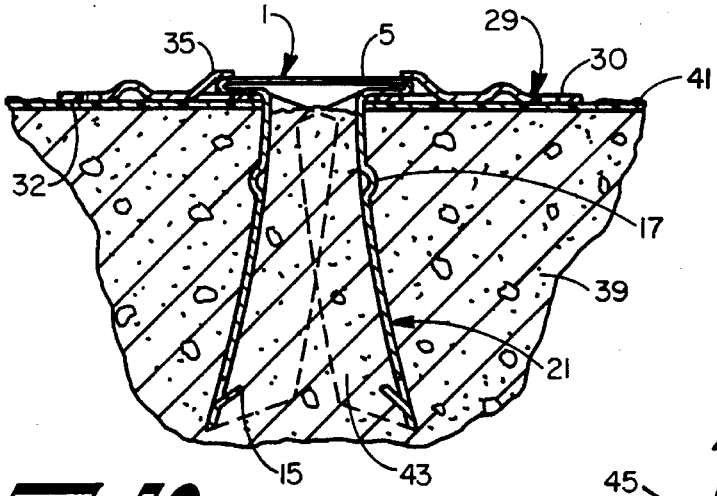
FIG. 10 is a longitudinal cross sectional view of the present invention shown in the operative mode.
Figure 11:
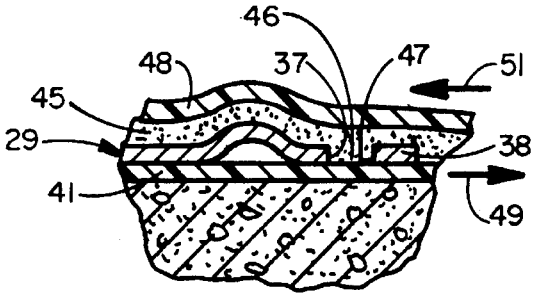
FIG. 11 is a partial cross sectional view on an enlarged scale of a portion of the plate of the present invention installed on a roof with a top ply overlying the plate.

FIGS. 10 and 11 show the fastener 1 and plate 29 of the invention in the operative mode. Reference numeral 39 represents a cementitious deck of a built-up roof. The cementitious deck 39 is covered with a base ply 41 of a flexible waterproof membrane. The fastener legs 21 are inserted through the central hole 31 of the plate such that the fastener head 5 rests on the plate upper surface 30. The plate tabs 35 are bent over to retain the fastener to the plate. The fastener is pushed through the base ply 41 and into the cementitious deck until the plate bottom surface 32 contacts the base ply. That action causes the fastener legs 21 to diverge and capture a concrete wedge 43 between them. The barbs 15 enable the fastener legs to capture a larger concrete wedge 43 than would be the case if the barbs were absent. In addition, the barbs dig into the concrete wedge under pullout forces exerted on the fastener heads.

The bumps 17 create pressure points between the fastener legs 21 and the cementitious roof deck 39. The pressure points increase the friction between the fastener 1 and the cementitious material to further resist pullout. The bumps therefore further contribute to the high fastener performance. The result is that the fastener exhibits greater pullout resistance than prior fasteners. That is especially important when repairing old roofs, as the present invention often allows use of existing cementitious decks instead of having to pour new decks.

The combination of the fastener 1 and the plate 29 meets Specification 1-90 for Class 1 roofs. In some applications, a lesser specification is sufficient. In those cases, it may not be necessary to use the plate in conjunction with the fastener. The fastener alone meets Specification 1-60 for Class 1 roofs, which is satisfactory in many buildings to hold the base ply 41 in place.

In FIG. 11, a layer of asphalt 45 is shown covering the plate 29 and the base ply 41. A top ply 48 overlies the asphalt layer. The asphalt 45 fills the openings 37 of the plate with asphalt plugs 46. The large areas of the plate openings provide correspondingly large areas 47 of adhesion between the asphalt plugs 46 and the base ply at the bottoms of the openings. The areas 47 act as shear areas that resist pulling of the base ply due to high pullover forces. Specifically, pulling of the base ply in the direction of arrow 49 during high winds is resisted with a resisting force in the direction of arrow 51 produced by the rim 38 of the plate 29 acting against the shear areas 47. The asphalt plugs also increase the adhesion between the base ply 41 and the top ply 48.

The plate 29 can also be used with single ply roofing systems, which are well known in the art. In that case, the plate is installed in the lap of a single ply roof cover, and an adhesive is used to bond the overlapped areas of the plys. The adhesive covers the plate, and the openings 37 increase the adhesion between the overlapped plys.

Thus, it is apparent that there has been provided, in accordance with the invention, a barbed light weight concrete fastener and plate that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A barbed light weight concrete fastener and plate comprising:

a. a plate fabricated as a disk of thin material having a periphery, a central hole, and a reinforcing rib between the periphery and the central hole, the plate defining a plurality of obround openings therethrough located between the periphery and the rib;

b. a fastener comprising:

i. a head defining a central axis;

ii. first and second legs having respective first ends bendably joined to the head and respective free ends and extending through the central hole in the plate, each fastener leg having a middle wall and two side walls, the legs being bendable between an inoperative mode whereat they internest and are generally parallel to the central axis and an operative mode whereat their free ends diverge;

iii. a barb located proximate the free end of each leg and protruding from the leg middle wall; and iv. a bump located intermediate the barb and the first end of each leg and protruding from the leg middle wall; and c. means for retaining the fastener head to the plate, so that the fastener legs when in the inoperative mode can be inserted through a base ply and into a cementitious material and the legs bend to the operative mode as the plate approaches the base ply and the barbs and the bumps enhance resistance to pullout of the fastener from the cementitious material.

2. The barbed light weight concrete fastener and plate of claim 1 wherein:

a. the plate has an outer diameter of approximately 2.70 inches;

b. the rib has an outer diameter of approximately 2.05 inches;

c. each opening has a length of approximately 0.50 inches and a width of approximately 0.13 inches; and d. each opening is at a distance of approximately 0.12 inches from the plate outer periphery.

3. The barbed light weight concrete fastener and plate of claim 2 wherein there are nine equidistantly spaced openings in the plate.

4. The barbed light weight concrete fastener and plate of claim 1 wherein the barbs protrude from the respective leg middle walls toward the head central axis.

5. The barbed light weight concrete fastener and plate of claim 1 wherein the bumps protrude from the respective leg middle walls away from the head central axis.

6. Apparatus for holding a flexible membrane to a roof deck of cementitious material comprising:

a. a plate having a bottom surface in facing contact with the membrane and a top surface, the plate having an outer periphery and a central hole; and b. a fastener having a head in facing contact with the plate top surface and a pair of diverging legs extending through the plate central hole and through the membrane and into the cementitious roof material to capture a concrete wedge therebetween, the legs having respective first ends bendably joined to the head, free ends, middle wall, and side walls, the leg middle walls having respective barbs protruding therefrom proximate the free ends thereof, the barbs digging into the cementitious roof material to resist pullout of the fastener from the cementitious roof material.

7. The apparatus of claim 6 wherein the barbs protrude from the respective leg middle walls facing each other, so that the barbs dig into the concrete wedge to resist pullout of the fastener from the cementitious roof material.

8. The apparatus of claim 6 further comprising a bump protruding from the middle wall of each leg between the barb thereon and the leg first end, the bumps creating pressure points between the fastener legs and the cementitious roof material to resist pullout of the fastener from the cementitious roof material.

9. The apparatus of claim 8 wherein the bumps on the respective legs protrude away from each other to thereby create pressure points on the cementitious roof material outside of the concrete wedge.

10. The apparatus of claim 9 wherein:

a. each leg is approximately 1.74 inches long; and b. each bump is located approximately 0.55 inches from the respective leg first end.

11. The apparatus of claim 6 wherein the plate defines a plurality of obround openings therethrough.

12. The apparatus of claim 11 wherein:

a. the plate defines a rib between the periphery and the central hole; and b. the obround openings are located between the rib and the periphery.

13. The apparatus of claim 11 further comprising a layer of asphalt covering the plate and the fastener head and forming plugs in the plate openings, the plugs of asphalt adhering to the membrane along respective shear areas generally coplanar with the plate bottom surface, so that pulling on the membrane is resisted by the plate adjacent the openings therethrough acting through the shear areas between the asphalt plugs and the membrane.

14. A light weight concrete fastener comprising:

a. a head defining a central axis; and b. first and second legs having respective first ends bendably joined to the head and respective second ends, each leg having a middle wall and two side walls, the legs being bendable between an inoperative mode whereat they internest and are generally parallel to the central axis and an operative mode whereat the legs diverge, the middle wall of each leg having a barb protruding therefrom proximate the free end thereof toward the head central axis, so that the fastener legs when in the inoperative mode can be inserted through a base ply and into a cementitious material and the legs bend to the operative mode as the head approaches the base ply and the barbs enhance resistance to pullout of the fastener from the cementitious material.

15. The light weight concrete fastener of claim 14 wherein the middle wall of each leg has a bump protruding therefrom intermediate the barb and the leg first end, so that the bumps enhance resistance to pullout of the fastener from the cementitious material.

16. The light weight concrete fastener of claim 15 wherein the bumps protrude from the respective leg middle walls away from the head central axis.

17. An article of manufacture useful as a plate in facing contact with a roofing base ply and covered with asphalt and a top ply, the plate having an outer periphery and a central hole and defining a plurality of obround openings therethrough proximate the outer periphery, so that the openings are filled with the asphalt to form plugs of asphalt in the respective openings that adhere to the base ply along shear areas that resist pulling of the base ply relative to the plate and that adhere the top ply to the base ply.

18. The article of manufacture of claim 17 wherein:

a. there is annular rib between the plate outer periphery and the central hole; and b. the openings are approximately equidistantly spaced around the plate periphery between the rib and the outer periphery.

19. The article of manufacture of claim 18 wherein:

a. the plate has an outer diameter of approximately 2.70 inches;

b. the rib has an outer diameter of approximately 2.05 inches;

c. each opening has a length of approximately 0.50 inches and a width of approximately 0.13 inches; and d. each opening is at a distance of approximately 0.12 inches from the plate outer periphery.

20. A method of holding a base ply to a cementitious roof material comprising the steps of:

a. providing a fastener having a head and two legs bendably joined to the head;

b. forming a barb protruding from each leg;

c. forming a bump on each leg of the fastener;

d. bending the fastener legs to an inoperative mode whereat the legs are generally parallel to each other;

e. inserting the fastener legs through the base ply and into the cementitious roof material and simultaneously bending the legs to diverge and capture a concrete wedge therebetween;

f. applying a pullout force on the fastener;

g. digging into the cementitious roof material with the barbs by digging into the concrete wedge with the barbs and thereby resisting the pullout force; and h. creating a pressure point and increasing friction between the fastener and the cementitious roof material at each bump and thereby further resisting the pullout force.

21. The method of claim 20 comprising the further steps of:

a. interposing a plate defining a plurality of openings therethrough between the fastener head and the base ply;

b. filling the plate openings with asphalt plugs and adhering the asphalt plugs to the base ply along respective shear areas;

c. applying a pulling force to the base ply; and d. resisting the pulling force on the base ply by the plate acting against the shear areas between the asphalt plugs and the base ply.

22. An article of manufacture useful as a plate in single ply roofing systems, the plate being in facing contact with a first roofing ply adjacent an edge thereof and covered with an adhesive, the plate having an outer periphery and a central hole and defining a plurality of obround openings therethrough proximate the outer periphery, so that the openings are filled with adhesive in the respective openings that adhere to the first roofing ply along shear areas that resist pulling of the first roofing ply relative to the plate and adhere to a second roofing ply that overlaps the first roofing ply along the edge thereof.

* * * * *